US010369456B1

(12) United States Patent
Syme

(10) Patent No.: US 10,369,456 B1
(45) Date of Patent: Aug. 6, 2019

(54) OUTDOOR DART TOSSING GAME

(71) Applicant: Blaine Syme, Beeton (CA)

(72) Inventor: Blaine Syme, Beeton (CA)

( * ) Notice: Subject to any disclaimer, the term of this patent is extended or adjusted under 35 U.S.C. 154(b) by 0 days.

(21) Appl. No.: 15/961,972

(22) Filed: Apr. 25, 2018

(51) Int. Cl.
*A63B 67/06* (2006.01)
*A63F 9/02* (2006.01)
*F41J 3/00* (2006.01)

(52) U.S. Cl.
CPC ..... *A63F 9/0208* (2013.01); *F41J 3/0071* (2013.01); *A63B 67/06* (2013.01); *A63F 2009/0221* (2013.01)

(58) Field of Classification Search
CPC ..... A63B 67/06; A63F 2250/024; A63F 2009/0221; F41J 5/26
USPC ..... 273/380–382, 398–402
See application file for complete search history.

(56) References Cited

U.S. PATENT DOCUMENTS 1,507,505 A * 9/1924 Munn ..... F41J 5/26 273/331
2,247,635 A * 7/1941 Illers ..... F41J 5/26 273/380
3,784,199 A 1/1974 Chmela
3,982,762 A 9/1976 Milicic
4,155,552 A * 5/1979 Jacobo ..... A63B 67/06 124/5
4,538,817 A * 9/1985 Ramella ..... A63F 9/0204 273/380
5,320,360 A * 6/1994 St. Pierre ..... A63F 9/0204 273/402
5,690,338 A * 11/1997 Cain ..... F41J 5/22 273/380
7,325,807 B1 * 2/2008 Eason ..... A63F 7/0005 273/342
7,845,644 B2 12/2010 Constantine
7,905,488 B2 3/2011 Fulgham
8,662,501 B1 * 3/2014 Perales ..... A63B 63/08 108/44
D706,355 S 6/2014 Montenare
9,192,837 B2 11/2015 Nally
2005/0104283 A1 * 5/2005 Hodgeman ..... A63F 7/06 273/108
2012/0169012 A1 7/2012 Parker
2017/0284775 A1 10/2017 Edminston
2018/0200600 A1 * 7/2018 Tiso ..... A63B 71/00

* cited by examiner

*Primary Examiner* — Mark S Graham

(57) ABSTRACT

An outdoor dart tossing game includes a target board that is positionable on a support surface. The target board has a plurality of target spaces therein. A plurality of canisters is included and each of the canisters contains a pressurized fluid. Each of the canisters is inserted into a respective one of the target spaces and each of the canisters is comprised of a rigid material. A plurality of darts is included and each of the darts is assigned to a respective player. Each of the darts is thrown towards the target board in the attempt of striking one of the canisters with the dart. Additionally, each of the canisters is pierced by the dart when the dart strikes the canister thereby releasing the pressurized fluid from the canister. In this way each of the canisters communicates a visual alert to the players that one of the canisters has been struck.

6 Claims, 6 Drawing Sheets

OUTDOOR DART TOSSING GAME

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dart game devices and more particularly pertains to a new dart game device for throwing darts at targets containing a pressurized fluid.

BRIEF SUMMARY OF THE INVENTION

An embodiment of the disclosure meets the needs presented above by generally comprising a target board that is positionable on a support surface. The target board has a plurality of target spaces therein. A plurality of canisters is included and each of the canisters contains a pressurized fluid. Each of the canisters is inserted into a respective one of the target spaces and each of the canisters is comprised of a rigid material. A plurality of darts is included and each of the darts is assigned to a respective player. Each of the darts is thrown towards the target board in the attempt of striking one of the canisters with the dart. Additionally, each of the canisters is pierced by the dart when the dart strikes the canister thereby releasing the pressurized fluid from the canister. In this way each of the canisters communicates a visual alert to the players that one of the canisters has been struck.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
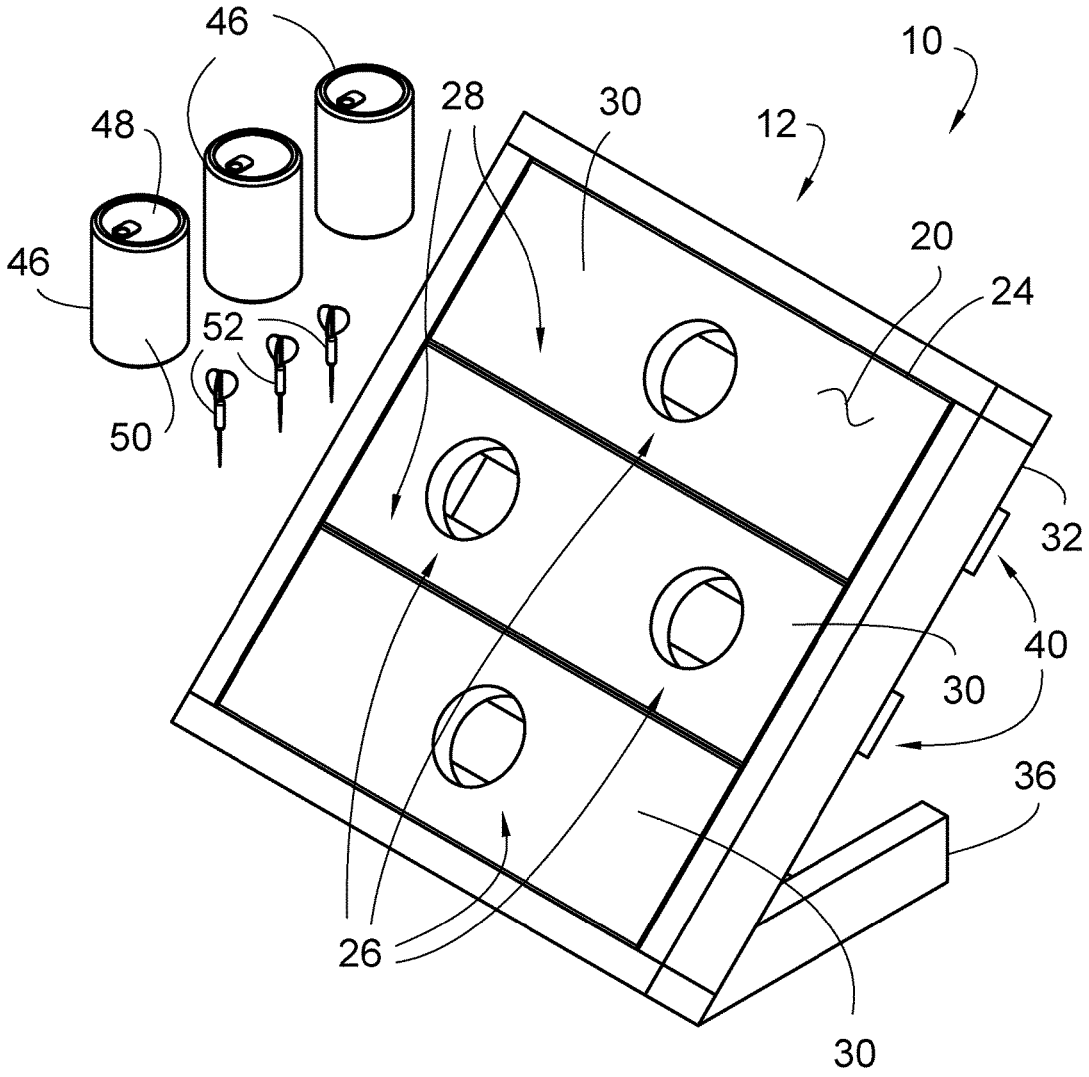
FIG. 1 is a front perspective view of an outdoor dart tossing game according to an embodiment of the disclosure.
Figure 2:
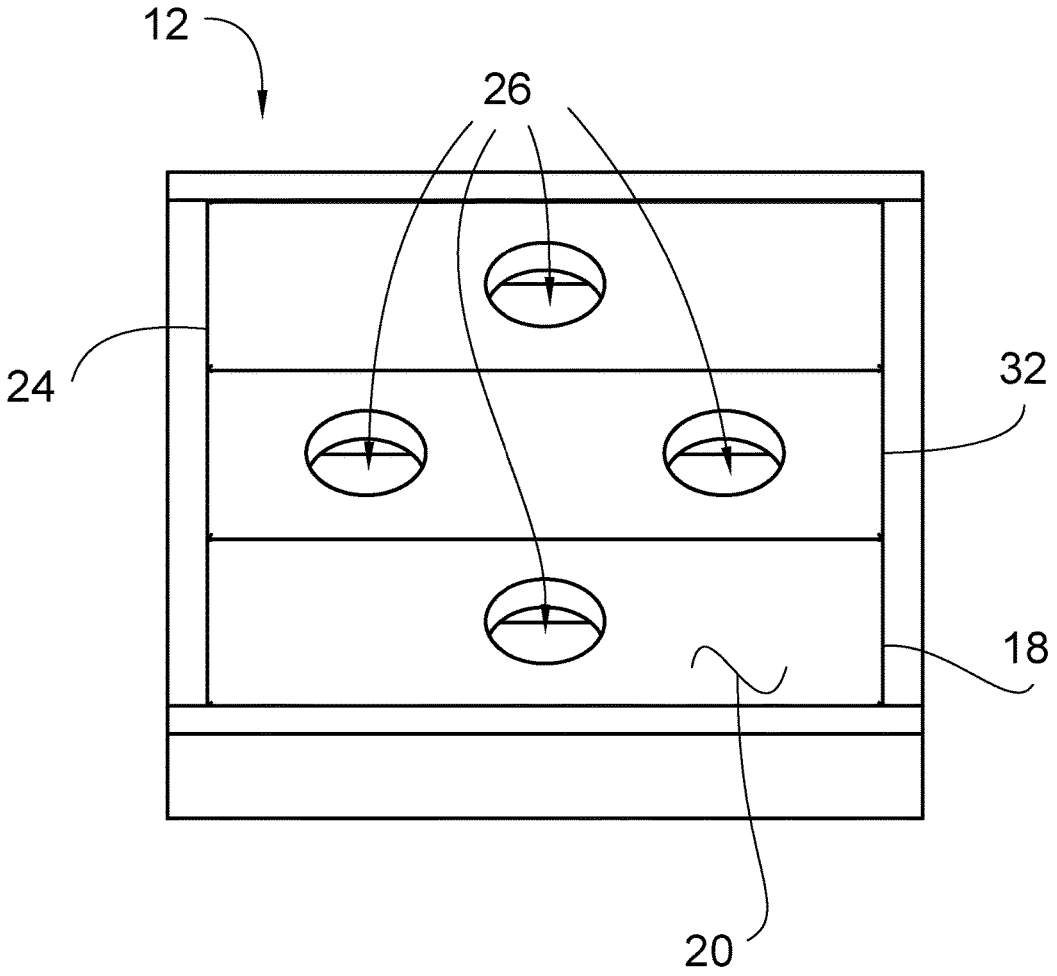
FIG. 2 is a front view of an embodiment of the disclosure.
Figure 3:
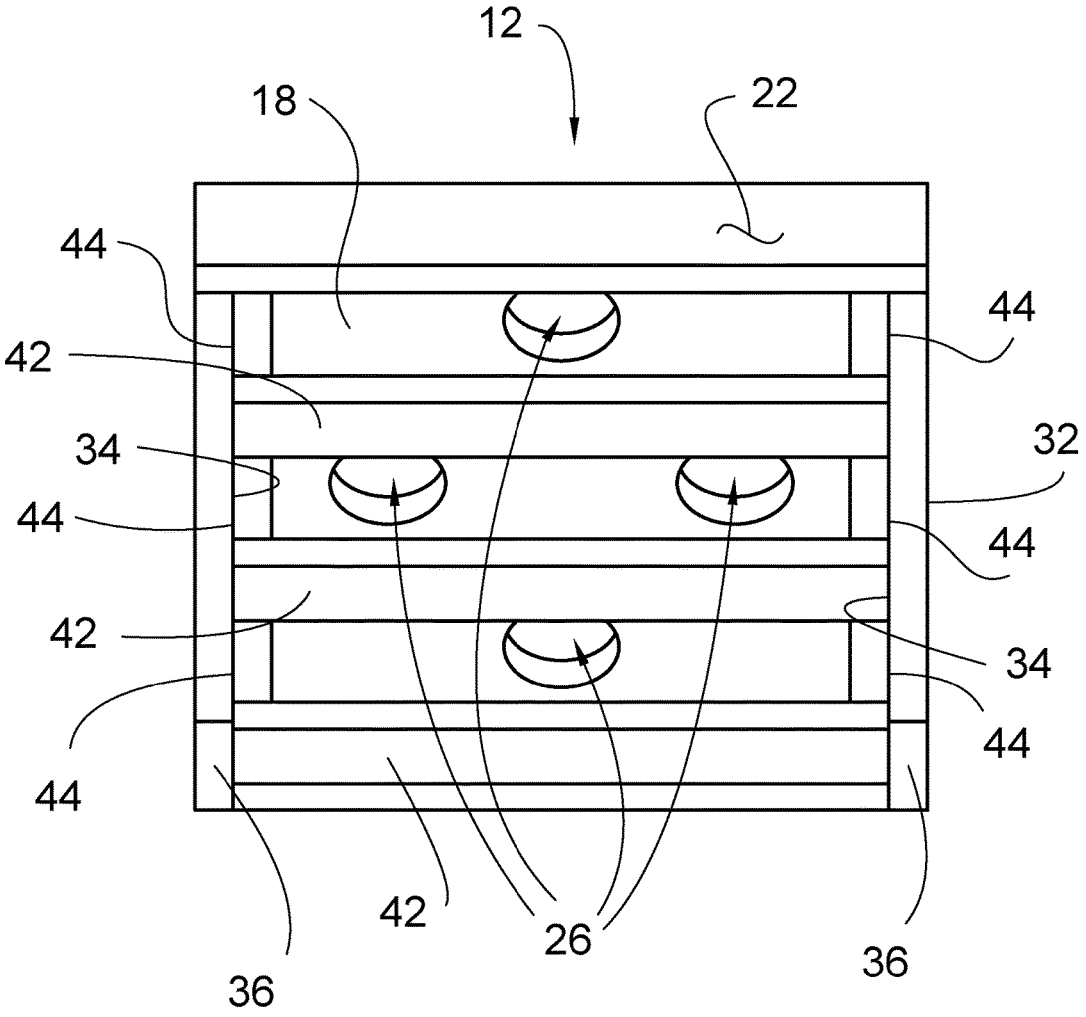
FIG. 3 is a back view of an embodiment of the disclosure.
Figure 4:
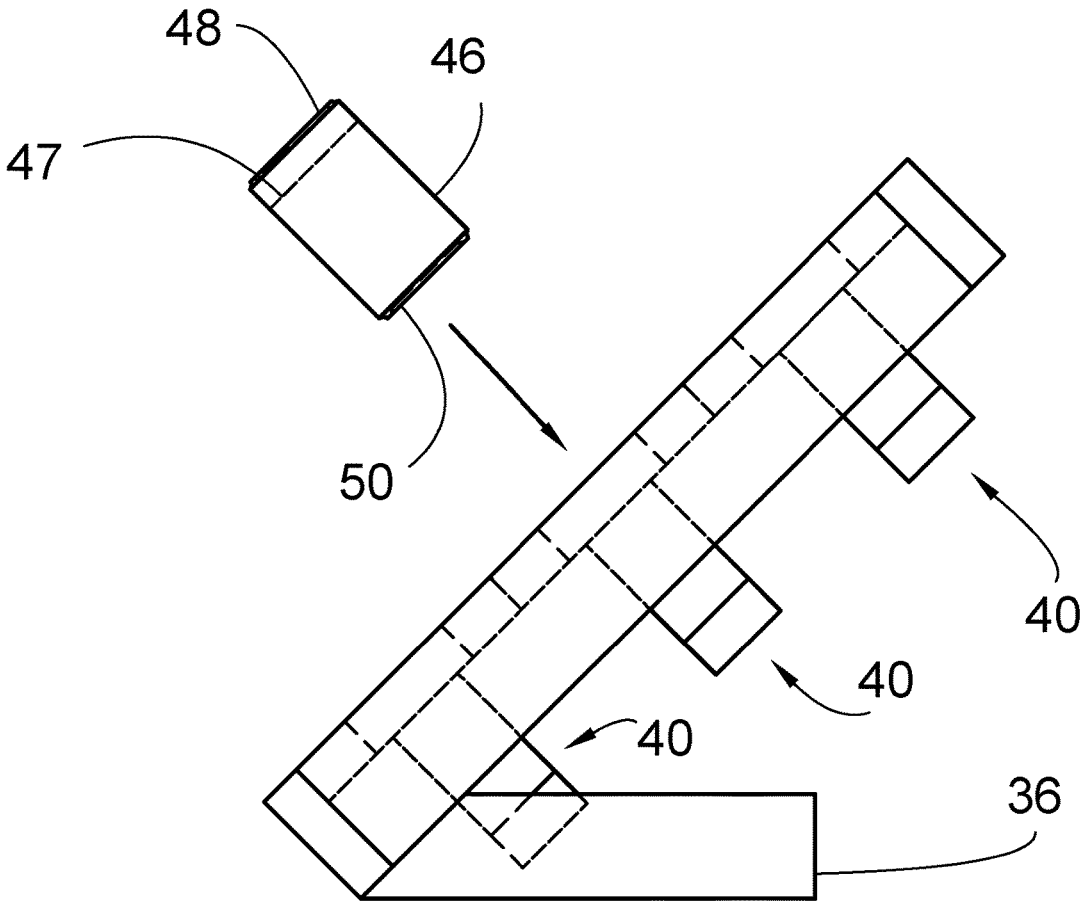
FIG. 4 is a right side phantom view of an embodiment of the disclosure.
Figure 5:
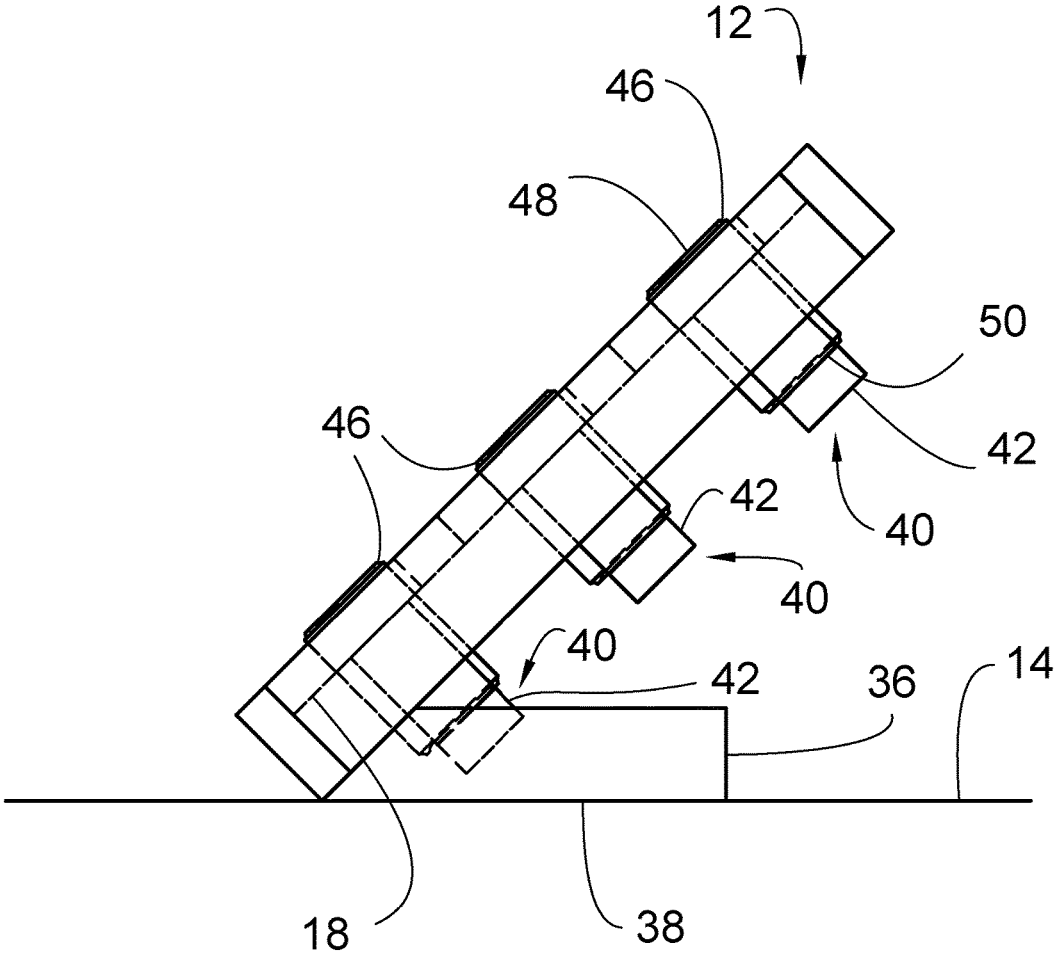
FIG. 5 is a right side phantom view showing a plurality of canisters being positioned in a plurality of target spaces of an embodiment of the disclosure.
Figure 6:
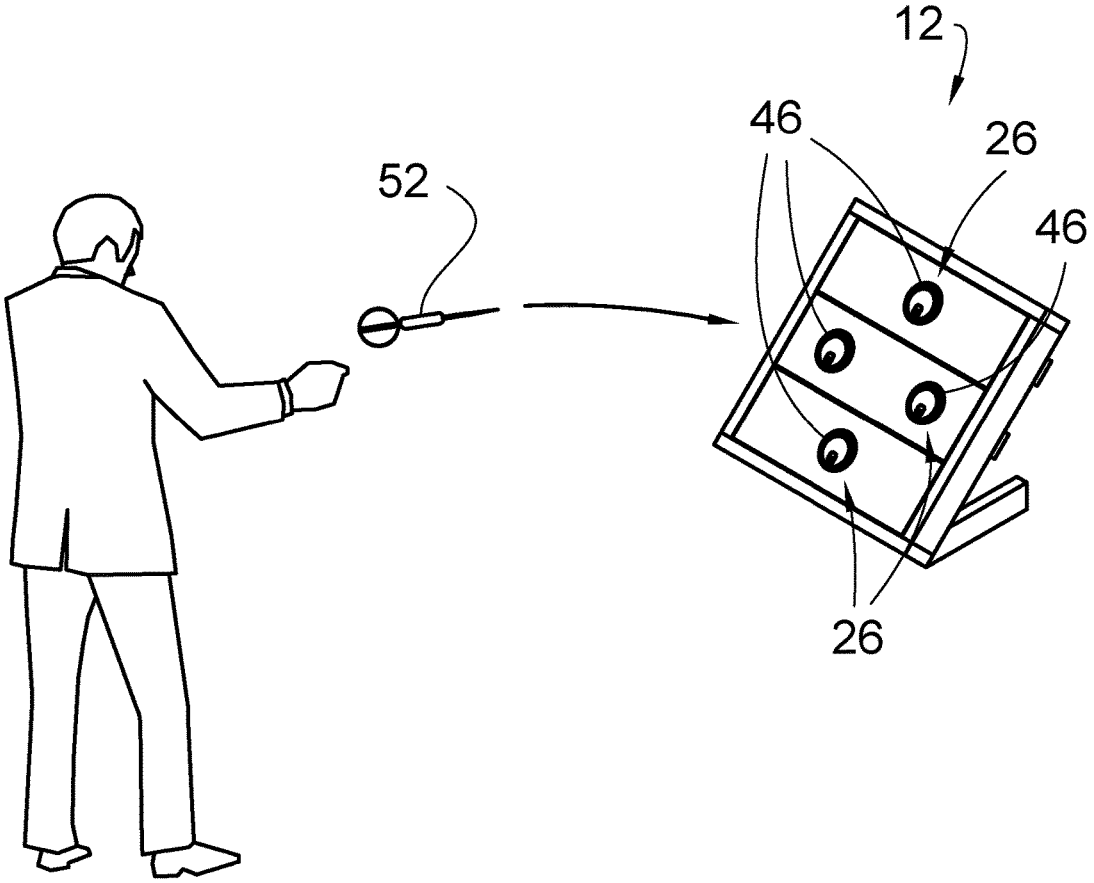
FIG. 6 is a perspective in-use view of an embodiment of the disclosure.

With reference now to the drawings, and in particular to FIGS. 1 through 6 thereof, a new dart game device embodying the principles and concepts of an embodiment of the disclosure and generally designated by the reference numeral 10 will be described.

As best illustrated in FIGS. 1 through 6, the outdoor dart tossing game 10 generally comprises a target board 12 that is positionable on a support surface 14, such as ground or other horizontal support surface 14. The target board 12 has a plurality of target spaces 16 therein. The target board 12 comprises a panel 18 that has a first surface 20, a second surface 22 and a perimeter edge 24 extending therebetween. Moreover, the panel 18 has a plurality of apertures 26 extending through the first surface 20 and the second surface 22, and the apertures 26 are spaced apart from each other and are distributed around the panel 18. The panel 18 may have a length and a width ranging between approximately 45.0 cm and 60.0 cm. Each of the apertures 26 may have a diameter of approximately 8.0 cm.

Indicia 28 are printed on the first surface 20 of the panel 18 and the indicia 28 comprise a plurality of colored bands 30 each extending laterally across the panel 18. Additionally, each of the colored bands 30 has a unique color with respect to each other. Each of the colored bands 30 is valued in descending order between 1.0 point, 2.0 points and 3.0 points. One of the apertures 26 may be positioned in the 1.0 point colored band, two of the apertures 26 may be positioned in the 2.0 point band and one of the apertures 26 may positioned in the 3.0 band.

A border 32 is coupled to and extends away from the second surface 22 of the panel 18 and the border 32 is coextensive with the perimeter edge 24. The border 32 has an inwardly facing surface 34. A pair of legs 36 is each coupled to and extends away from the second surface 22 of the panel 18. Each of the legs 36 is oriented on a line forming an acute angle with respect to the second surface 22. Moreover, each of the legs 36 has a bottom side 38 and the bottom side 38 of each of the legs 36 rests on the support surface 14 such that the panel 18 angles upwardly from the support surface 14. The panel 18 may be positioned at a target angle with respect to the support surface 14 ranging between approximately 45.0 degrees and 60.0 degrees.

A plurality of supports 40 is provided and each of the supports 40 includes a central member 42 extending between a pair of outward members 44. Each of the outward members 44 of each of the supports 40 is coupled to the inwardly facing surface 34 of the border 32. The central member 42 of each of the supports 40 is spaced from the second surface 22 of the panel 18. Moreover, the central member 42 of each of the supports 40 is aligned with a respective one of the apertures 26 in the panel 18. Thus, the central member 42 of each of the supports 40 and the respective aperture defines each of the target spaces 16. The central member 42 of each of the supports 40 is horizontally oriented to extend laterally across the panel 18.

A plurality of canisters 46 is provided and each of the canisters 46 contains a pressurized fluid 47. Each of the canisters 46 may comprise soda cans, beer cans and any other carbonated beverage can. Additionally, the pressurized fluid 47 in the canisters 46 may be a carbonated beverage, such as beer, soda and any other pressurized fluid 47 that is non-toxic to human beings. Each of the canisters 46 is inserted into a respective one of the target spaces 16 and each of the canisters 46 is comprised of a rigid material, such as aluminum or the like.

Each of the canisters 46 has a first end 48 and a second end 50, and each of the canisters 46 is inserted into a respective one of the apertures 26. The second end 50 of each of the canisters 46 abuts the central member 42 of the support corresponding to the respective aperture. Thus, each of the canisters 46 is retained in the target board 12 having the first end 48 of the canisters 46 being aligned with the first surface 20 of the panel 18. Additionally, each of the canisters 46 may extend beyond the first surface 20 of the panel 18 such that the first end 48 of each of the canisters 46 is exposed. Each of the canisters 46 may be beverage cans provided by each player, beverage cans provided by a host and any other source or type of beverage can.

A plurality of darts 52 is provided and each of the darts 52 is assigned to a respective player. Each of the darts 52 is thrown towards the target board 12 in the attempt of striking one of the canisters 46 with the dart 52. Moreover, each of the canisters 46 is pierced by the dart 52 when the dart 52 strikes the canister thereby releasing the pressurized fluid 47 from the canister. In this way each of the canisters 46 communicates a visual alert to the players that one of the canisters 46 has been struck. Each of the darts 52 may be dartboard throwing darts 52 of any conventional design.

In use, the target board 12 is placed on the ground outdoors such that the legs 36 retain the panel 18 at the target angle with the support surface 14. Each of the canisters 46 is positioned into a respective one of the apertures 26 and rests on the central member 42 of the corresponding support. Thus, the first end 48 of each of the canisters 46 is exposed to present a target for the darts 52. Each player takes turns throwing one or more darts 52 at the panel 18 in the attempt at striking one of the canisters 46. The pressurized fluid 47 in the canisters 46 sprays outwardly from the canisters 46 when the canisters 46 are pierced with a dart 52. Corresponding points are awarded when the canister in each of the colored bands 30 on the panel 18. The canister that is struck is replaced with a new canister and the game continues. The first player or team of players to reach 21.0 points wins the game.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An outdoor dart tossing game having a plurality of pressurized targets wherein said targets are configured to explode when struck by a dart, said assembly comprising:

a target board being positionable on a support surface, said target board having a plurality of target spaces therein, said target board comprising a panel having a first surface, a second surface and a perimeter edge extending therebetween, said panel having a plurality of apertures extending through said first surface and said second surface, said apertures being spaced apart from each other and being distributed on said panel;

a border being coupled to said and extending away from said second surface of said panel, said border being coextensive with said perimeter edge, said border having an inwardly facing surface;

a plurality of supports, each of said supports having a central member extending between a pair of outward members, each of said outward members of each of said supports being coupled to said inwardly facing surface of said border such that said central member of each of said supports is spaced from said second surface of said panel;

a plurality of canisters, each of said canisters containing a pressurized fluid, each of said canisters being inserted into a respective one of said target spaces, each of said canisters being comprised of a rigid material; and a plurality of darts, each of said darts being assigned to a respective player, each of said darts being thrown towards said target board in the attempt of striking one of said canisters with said dart, each of said canisters being pierced by said dart when said dart strikes said canister thereby releasing said pressurized fluid from said canister wherein each of said canisters is configured to communicate a visual alert to the players that one of said canisters has been struck.

2. The assembly according to claim 1, further comprising a pair of legs, each of said legs being coupled to and extending away from said second surface, each of said legs being oriented on a line forming an acute angle with respect to said second surface, each of said legs having a bottom side, said bottom side of each of said legs resting on the support surface such that said panel angles upwardly from the support surface.

3. The assembly according to claim 1, wherein said central member of each of said supports is aligned with a respective one of said apertures in said panel such that said central member of each of said supports and said respective aperture defines each of said target spaces, said central member of each of said supports being horizontally oriented to extend laterally across said panel.

4. The assembly according to claim 3, wherein each of said canisters has a first end and a second end, each of said canisters being inserted into a respective one of said apertures.

5. The assembly according to claim 4, wherein said second end of each of said canisters abuts said central member of said support corresponding to said respective aperture having said first end of said canisters being aligned with said first surface of said panel.

6. An outdoor dart tossing game having a plurality of pressurized targets wherein said targets are configured to explode when struck by a dart, said assembly comprising:

a target board being positionable on a support surface, said target board having a plurality of target spaces therein, said target board comprising:

a panel having a first surface, a second surface and a perimeter edge extending therebetween, said panel having a plurality of apertures extending through said first surface and said second surface, said apertures being spaced apart from each other and being distributed on said panel;

a border being coupled to said and extending away from said second surface of said panel, said border being coextensive with said perimeter edge, said border having an inwardly facing surface;

a pair of legs, each of said legs being coupled to and extending away from said second surface, each of said legs being oriented on a line forming an acute angle with respect to said second surface, each of said legs having a bottom side, said bottom side of each of said legs resting on the support surface such that said panel angles upwardly from the support surface; and a plurality of supports, each of said supports having a central member extending between a pair of outward members, each of said outward members of each of said supports being coupled to said inwardly facing surface of said border such that said central member of each of said supports is spaced from said second surface of said panel, said central member of each of said supports being aligned with a respective one of said apertures in said panel such that said central member of each of said supports and said respective aperture defines each of said target spaces, said central member of each of said supports being horizontally oriented to extend laterally across said panel;

a plurality of canisters, each of said canisters containing a pressurized fluid, each of said canisters being inserted into a respective one of said target spaces, each of said canisters being comprised of a rigid material, each of said canisters having a first end and a second end, each of said canisters being inserted into a respective one of said apertures, said second end of each of said canisters abutting said central member of said support corresponding to said respective aperture having said first end of said canisters being aligned with said first surface of said panel; and a plurality of darts, each of said darts being assigned to a respective player, each of said darts being thrown towards said target board in the attempt of striking one of said canisters with said dart, each of said canisters being pierced by said dart when said dart strikes said canister thereby releasing said pressurized fluid from said canister wherein each of said canisters is configured to communicate a visual alert to the players that one of said canisters has been struck.

* * * * *